United States Patent [19]

Skvaril

[11] 4,441,286

[45] Apr. 10, 1984

[54] PREFABRICATED CUBE CONSTRUCTION SYSTEM FOR HOUSING AND CIVIC DEVELOPMENT

[76] Inventor: Joseph Skvaril, 4807 - 143rd St., Edmonton, Alberta, Canada, T6H 4C9

[21] Appl. No.: 331,007

[22] Filed: Dec. 15, 1981

Related U.S. Application Data

[63] Continuation-in-part of Ser. No. 66,544, Aug. 9, 1979, abandoned, which is a continuation-in-part of Ser. No. 816,526, Jul. 18, 1977, abandoned.

[30] Foreign Application Priority Data

Oct. 11, 1977 [CA] Canada ..... 1018719

[51] Int. Cl.[3] ..... E04H 1/00

[52] U.S. Cl. ..... 52/79.1; 52/79.7; 52/79.9; 52/234; 52/236.3

[58] Field of Search ..... 52/79.1, 79.2, 79.3, 52/79.4, 79.5, 79.7, 79.9, 263, 234, 262, 648, 125, 236.3, 221, 637

[56] References Cited

U.S. PATENT DOCUMENTS

| | | | |
|---|---|---|---|
| 3,526,067 | 9/1970 | Foster et al. | 52/79.1 |
| 3,564,786 | 2/1971 | Baker | 52/637 X |
| 4,065,905 | 1/1978 | van der Lely | 52/79.1 X |
| 4,067,159 | 1/1978 | Juriss et al. | 52/79.2 X |
| 4,272,930 | 6/1981 | Foster | 52/79.1 |

FOREIGN PATENT DOCUMENTS

| | | | |
|---|---|---|---|
| 1953657 | 12/1978 | Fed. Rep. of Germany | 52/79.1 |
| 2040334 | 8/1980 | United Kingdom | 52/79.1 |

*Primary Examiner*—Carl D. Friedman
*Attorney, Agent, or Firm*—Stanley G. Ade

[57] ABSTRACT

A prefabricated statically self-contained cube skeleton unit system is provided comprising two standard square or rectangular ceiling/floor component frames supported on four L-shaped corner wall frames, each supported on the lower frame at three points and each supporting the upper frame also at three points, both of these constituting a standard skeleton unit which can be stacked in vertical direction into a two or more storey cube skeleton with the use of one standard square or rectangular ceiling/floor component between lower and upper cube skeleton storey and which, by attaching one statically self-containing cube skeleton to the other, allows for developing a multi-room clustered structure of unlimited size in horizontal directions of one or more storeys. The vertical openings in the cube skeleton allow for the use of statically non-bearing fill-in walls which can be exchanged, removed and re-erected.

18 Claims, 12 Drawing Figures

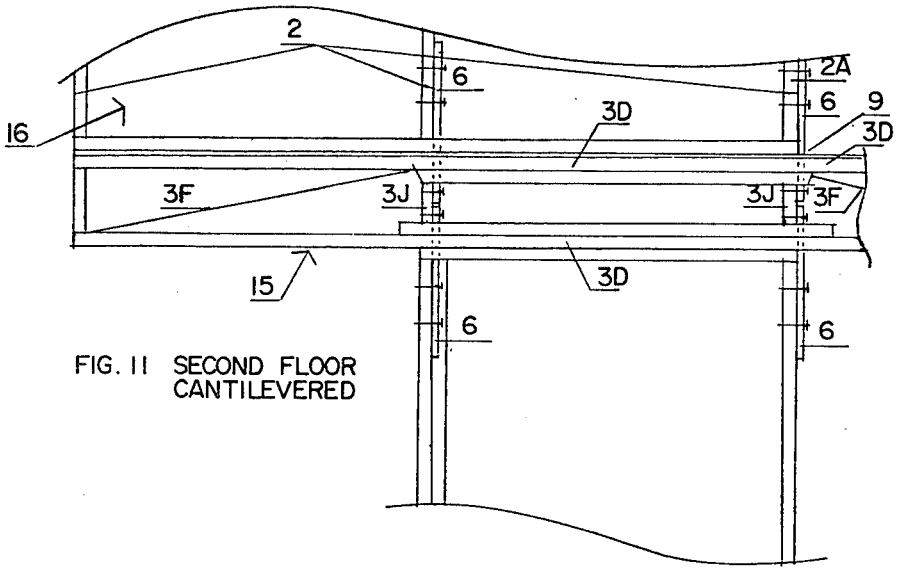
FIG. 11 SECOND FLOOR CANTILEVERED
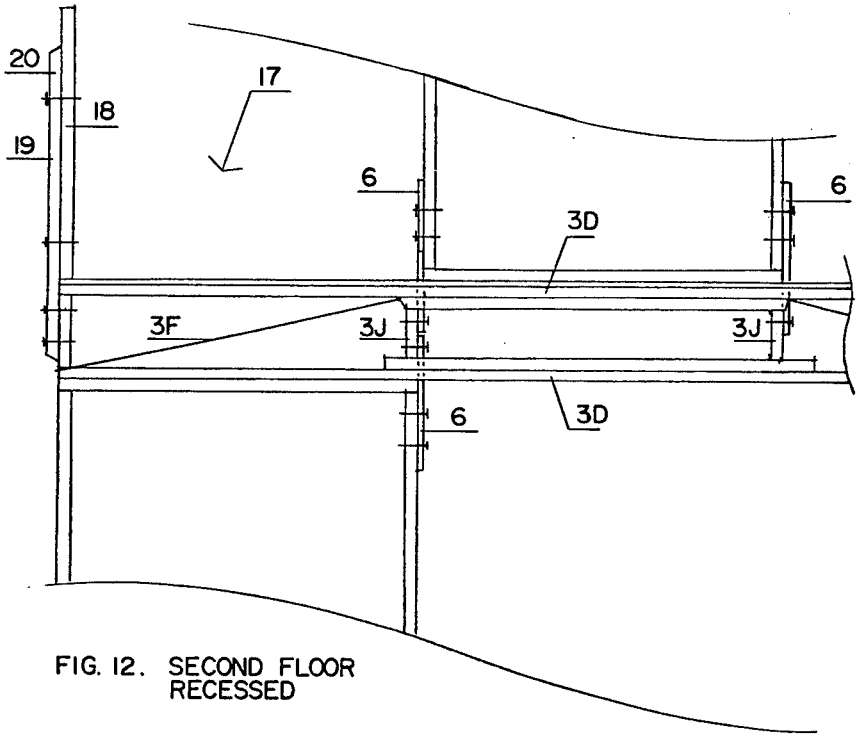
FIG. 12. SECOND FLOOR RECESSED

PREFABRICATED CUBE CONSTRUCTION SYSTEM FOR HOUSING AND CIVIC DEVELOPMENT

This application is a continuation-in-part application of application Ser. No. 066,544 filed Aug. 9th, 1979, which is a continuation-in-part application of application Ser. No. 816,526 filed July 18th, 1977, now abandoned.

BACKGROUND OF THE INVENTION

This invention relates to new and useful improvements of construction of houses, civic buildings and the like because it allows for expansion or reduction in size of any house or other structure and increases the effectiveness of its mobility and flexible uses.

Present development requirements include more flexibility in using structures of a higher degree of standardization and provisions in structure for easy expansion or reduction in size. This cannot be easily achieved by conventional means, because any alteration of a structure causes a large number of man/hours to be spent on site, and for various manual operations due to lack of integrity of coordination of sub-trade work. This can only be resolved by the present invention which is based on philosophy of details minimizing problems of connecting walls to floors and therefore reducing interdependency on one sub-trade work on the others.

In the housing industry the present invention allows for the construction of small houses which could however, be expanded after the financial capabilities of families improves. On the other hand, larger houses could also be reduced in size when necessary, or when the excessively large volume of house is not needed.

This invention also allows for conversion of one structure type to another. A number of houses which no longer needed on the site, can for example, be easily removed for the construction of a small civic building. These are the principal improvements in construction industry which this invention offers.

SUMMARY OF THE INVENTION

This invention relates to a new construction system for prefabricated structures in which the basic cube skeleton unit is comprised of two similar square or rectangular ceiling/floor frames and four similar standard corner wall frames. The cube-like skeleton can easily accommodate a square or rectangular fill-in ceiling in its ceiling/floor member and also a fill-in wall between the two horizontal ceiling/floor frame members and between adjacent corner wall frames.

Ceiling/floor component is defined by the perimetrical frame and fill-in ceiling/floor of any material and any shape within a reasonable span, generally not exceeding 14 to 16 feet.

The prefabricated corner wall is developed for the purpose of transmission of loads into the perimetrical frame at three points, or at the corner wall perimeter, bracing the skeleton unit and also for the purpose of exclusion of complicated joint work whenever it is located at the corner. This invention locates the joins between corner walls and fill-in walls between two straight lines of the perimetrical frame and the opening for the fill-in wall is clearly defined. The corner wall may be constructed from any material provided only that it is tied to the frame at least at three points. The corner wall may be sufficient for bracing or may share the bracing for an exposed structure with the fill-in wall. All tolerances occur in the most safe and convenient locations, and reinforcing continuity is assured. Also, all electrical wiring is preferably installed when the components are prefabricated.

The fill-in wall may or may not share the compression or stresses along the perimeter of the frame, depending entirely upon the materials used and the most economical alternative for structural treatment of stress, which means either through corner wall, ceiling/floor frame connectors, or in the form of share stress with the fill-in wall. If necessary, the cube skeleton may, however, also be replaced by metal strapping of X-shape between the two ceiling/floor frames and between the frames of the corner walls.

In case of horizontal expansion, one cube unit may be added to the others in statically independent manner. One or any number of cube units may easily be removed from the multi-unit structure, because each of the units is statically self-sustaining and independent from the others.

In the case of vertical expansion, the perimetrical frame of the ceiling component of the lowermost unit becomes automatically the perimetrical frame of the floor of the uppermost unit, which identifies the ceiling/floor frame as a universal component thereby developing inter-dependency of one floor with the other through that perimetrical frame and of course, through the frames of the vertical corner walls, each connected to the perimetrical frame at three points at least.

The above cube skeleton frame system is based on the independency of each single or stacked cube skeleton unit from the others, and inter-dependency in terms of stacking one cube over the other. Fill-in walls may only be installed after the skeletons are erected, regardless of whether the walls on the second floor are installed first or as a last phase of the construction process.

The cube skeleton system predetermines the following flow of assembly:

Step 1—Floor component or number of floor components is, or are, laid as a platform on any basement wall or timber support or slab.

Step 2—Corner wall components are installed and anchored to the perimetrical frames of the floor components. The connectors between the corner wall frames and floor frames are not tightened or entirely tied, in order to allow for minimum tolerance during assembly. They are used only to secure the cube skeleton for safety reasons at this time.

Step 3—Ceiling/floor components are to be erected and secured by connectors to the upper ends of the corner wall component frames.

Step 4—Fill-in walls are to be placed in the openings of the cube skeleton and secured in place.

Regarding specific aspects of the assembly, these processes apply:

when corner walls are erected, the access to connectors between the corner wall frames and ceiling/floor frames are from the inside of the cube skeleton, either on or below the ceiling/floor component.

The ceiling/floor component and the corner wall frames may be connected in vertical direction by rods screwed or otherwise secured to the corner wall frame and to the vertical web of the ceiling/floor frame, or are only screwed or otherwise secured to the corner wall frame and bolted to the upper or lower chord of the frame. Regardless of the type of connector used, it will always be dealt with from the side and only in the vertical direction, because only in this way are the stresses in the cube structure minimized and static forces are primarily related to suspension.

Once the fill-in wall is placed between adjacent corner wall frames and the ceiling/floor frames, it may only be connected with the cube skeleton from the inside space of the ceiling/floor component by screwing or otherwise securing, the upper or lower chord of the ceiling/floor frame to the top and bottom plate of the fill-in wall. Spaces between corner wall frame and fill-in wall frame may be caulked from the inside or also from the outside whenever necessary. Metal plate connectors, either flat or corner-shaped, are only used for securing the corner wall component at its corner to the corner of the ceiling/floor frame.

The location, size and shape of the apertures in ceiling/floor frame for the connectors, is coordinated with the most desirable location of electrical wiring connection between ceiling/floor component and the fill-in wall.

All sub-trade work such as electrical and mechanical is completed primarily in production premises. All work on site regarding connecting the mechanical and electrical portions of the cube unit are done from a working platform which is the central portion of the cube unit floor while the perimetrical space along the frame of the ceiling/floor component remains open for maintenance and connection of components until such time as the entire structure is erected and the sub-trade work in cube skeleton and fill-in walls is completed.

This invention also integrates in transportation, the advantages of modular and package systems.

When erected on the side, the prefabricated cube units do not require heavy cranes. The components are, in this coordinated manner, designed also for easy transportation and use and re-use of each of the components at any time.

This summary shows only one of many material conversions which can be used for the implementation of the cube structure in conforming with the principles of the invention. In this case this is a wood frame structure. A possible application of steel members would make the invention usable in those countries in which fire codes prevent building wood frame structures.

The same invention can also be applied in reinforced concrete, again depending upon climate and convenience. The wood frame structure is however, very feasible for house construction in North America.

In accordance with the invention there is provided a plurality of statically complete and independent cube skeleton structural unit components for detachable arrangement and securement together with adjacent surfaces being in interfacial flush relationship, each of said components comprising in combination a pair of similar square horizontal ceiling/floor components each including a perimetrical frame and load bearing means for maintaining the components in spaced and parallel relationship with one another, said load bearing means consisting solely of four L-shaped cross sectioned corner bearing wall components each of which directly abuts and is secured at each end thereof to a corresponding corner of the associated frame of said horizontal components at the upper and lower edges of the bearing wall components, vertically extending means for operatively and detachably connecting said ceiling/floor components and said bearing wall components together, each of said bearing wall components together, each of said bearing wall components including a pair of vertically situated flanges at right angles to one another for reducing the span of the roof component frame members, the thickness of the perimetrical frame and the thickness of the flanges of the L-shaped bearing wall components being similar to produce a flush fitting smooth inner and outer surface therebetween in which the centre line of the perimetrical frame and the centre line of each of the flanges of the L-shaped bearing wall components are correspondingly vertical thus developing the said statically complete and independent cube skeleton structural unit, fill-in, non-bearing wall components detachably secured between the outer edges of said horizontal components and extending therebetween, the thickness of said non-bearing wall components being substantially equal to the thickness of the vertically situated flanges of said bearing wall components and at least one lateral edge of the non-bearing wall components being secured to a corresponding lateral edge of said vertically situated flange so that the non-bearing wall components form a flush continuation of said vertically situated flange of said bearing wall components.

In accordance with a further embodiment of the invention, there is provided a plurality of statically complete and independent cube skeleton structure units as defined in Claim 1, detachably arranged together to form a complete multi-roomed structure with no static relation of one cube structure to the other in horizontal arrangement but in static stacked frame inter-relationship of two cube structure units when stacked one above the other, both sharing one common ceiling/-floor component and including a lowermost ceiling/-floor component, an L-shaped bearing wall component extending upwardly from the corners of said lowermost ceiling/floor component and being secured thereto, a common ceiling/floor component secured to the upper ends of said L-shaped bearing wall components, a further L-shaped bearing wall component adjacent each corner of said common ceiling/floor component and extending upwardly therefrom and being secured thereto and an uppermost ceiling/floor component secured to the upper ends of said further L-shaped bearing wall components.

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred typical embodiment of the principles of the present invention, in which:

DESCRIPTION OF THE DRAWINGS

FIGS. 3A and 3B show an isometric fragmentary view of alternate corner structures.

FIG. 11 shows a fragmentary, partially schematic side elevation including a second floor cantilevered extension.

FIG. 12 is a view similar to FIG. 11, but showing the cantilevered extension used as a balcony.

In the drawings like characters of reference indicate corresponding parts in the different figures.

DETAILED DESCRIPTION

Figure 1:
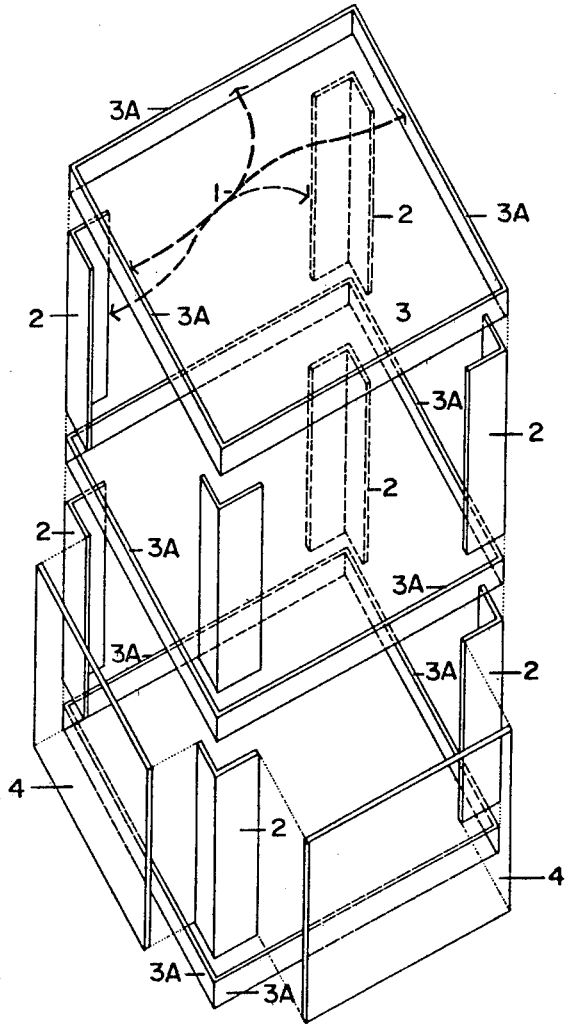
FIG. 1 is an axonometric schematic exploded view of the two-storey cube skeleton.

Proceeding therefore to describe the invention in detail, FIG. 1 shows the stacked cube skeleton which consists of two single cube units. The ceiling component of the lower unit automatically becomes the floor component of the upper unit. This ceiling/floor component is a transitional member of the stacked cube skeleton.

Reference character 1 illustrates generally, the cube skeleton members. Corner wall components are designated 2 and 3A is a ceiling/floor component frame, reference 4 is a fill-in wall component.

Figure 2:
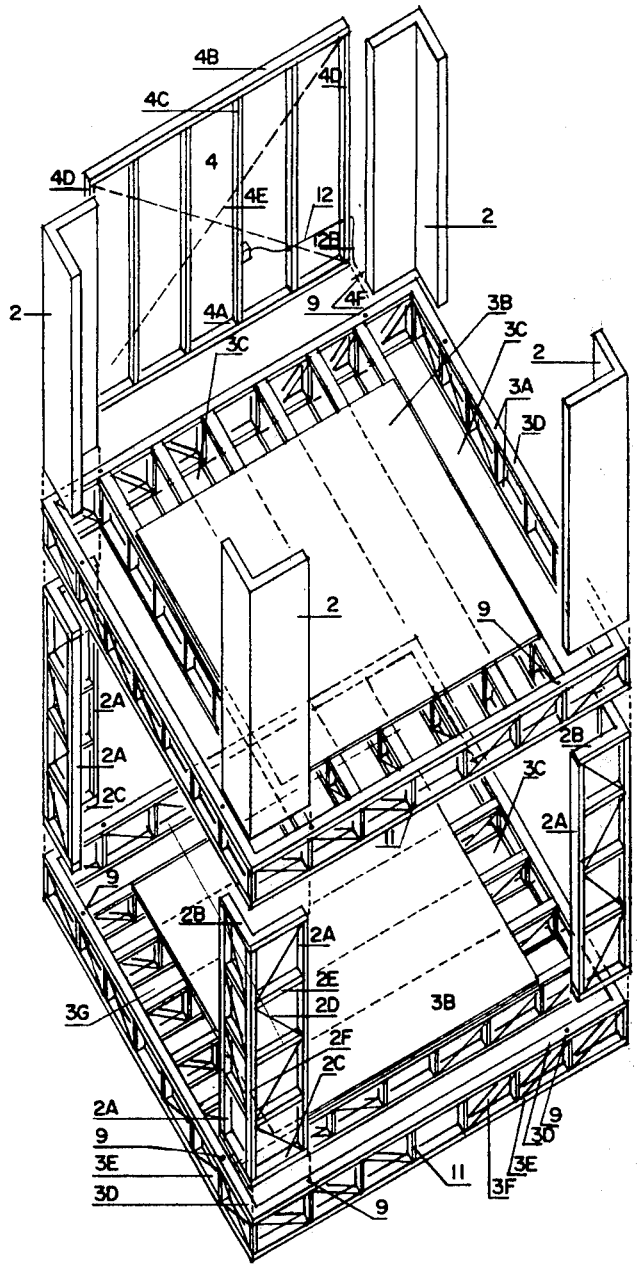
FIG. 2 is an axonometric view of two-storey cube skeleton structure partially exploded.

The size of the cube skeleton unit is, for example, 4.2×4.2 m or 4.2×4.8 or 5.4 or 6.0 m. In ordinary construction practice, this size of cube skeleton will cover most of the typical house and small civic building structures. The size of the corner wall component is not necessarily limited in one or two directions, however, this invention is focused on multiplication of 2 feet or 0.6 m module. FIG. 2 illustrates the floor component, indicated at 3, corner wall component indicated at 2 and fill-in wall components indicated at 4.

The transition or common ceiling/floor component in FIG. 2 includes a perimetrical frame 3A consisting of spaced and parallel upper chord 3D and lower chord 3E, webs 3F and openings 9 in upper and lower chords for corner wall frame and ceiling/floor frame connectors and electrical wiring. Spacing of joists 3G is preferably 1/7th of the width of the ceiling/floor component or 0.6 m, in this example. The joists can be laid in parallel or perpendicular directions to one of the sides of the square ceiling/floor components 3.

Corner wall components 2 include vertical frame members 2A, top plates 2B, bottom plates 2C, webs 2D and spaced and parallel perpendicular webs 2D. However, these can be easily substituted by sheathing or by metal strapping, or any other means of safe bracing, depending upon design parameters.

For the purpose of erection of corner wall components from the inside of the cube skeleton, the ceiling/floor component 3 includes a platform as shown at 3B having dimensions less than the ceiling/floor frame thus providing unlimited access to the inside perimeter of the frame and also to the top and bottom plates of the corner wall components from the spaces 3C.

The fill-in wall components 4 each consist of bottom plate 4A, spaced and parallel top plate 4B, studs 4C and outer frame studs 4D. The width of the fill-in wall should allow for tolerance or clearance at 4F in a horizontal direction and for a minor tolerance or clearance in a vertical direction. The height of the fill-in wall is slightly less than the height of the corner wall. The join or junction 4F should be wide enough to allow for the pick-up of electrical wiring 12B and connection of the wires between the fill-in wall component and the ceiling/floor frame or component. Bracing in the fill-in wall component may be secured by sheathing or strapping 4E. Spacing of studs is the same as the spacing of the joists which 0.6 m or 2 feet, in this example.

The ceiling/floor components may include electrical wiring, mechanical heating channels and possibly even insulation if applicable. The majority of the sub-floor and ceiling drywall may be screwed or secured to the joists during prefabrication leaving the perimetrical access spaces or areas around same. This will ensure a proper bracing of the ceiling/floor components during transportation prior to construction, and also during the process of manipulation on site.

The fill-in wall components may have insulation, vapour barrier, exterior and interior finish in place because the securing of the fill-in wall components in the cube skeleton frame is through the bottom and top plates, accessed through the perimetrical spaces of the ceiling/floor member. Wiring 12 connecting an electrical outlet 2A from any place on the fill-in wall component with ceiling/floor component is laid out through the end stud 4D and through the opening 9 in either the upper or lower chord of the perimetrical frame. The above cube skeleton members can easily be developed in steel, concrete or plastic materials.

Figure 3:
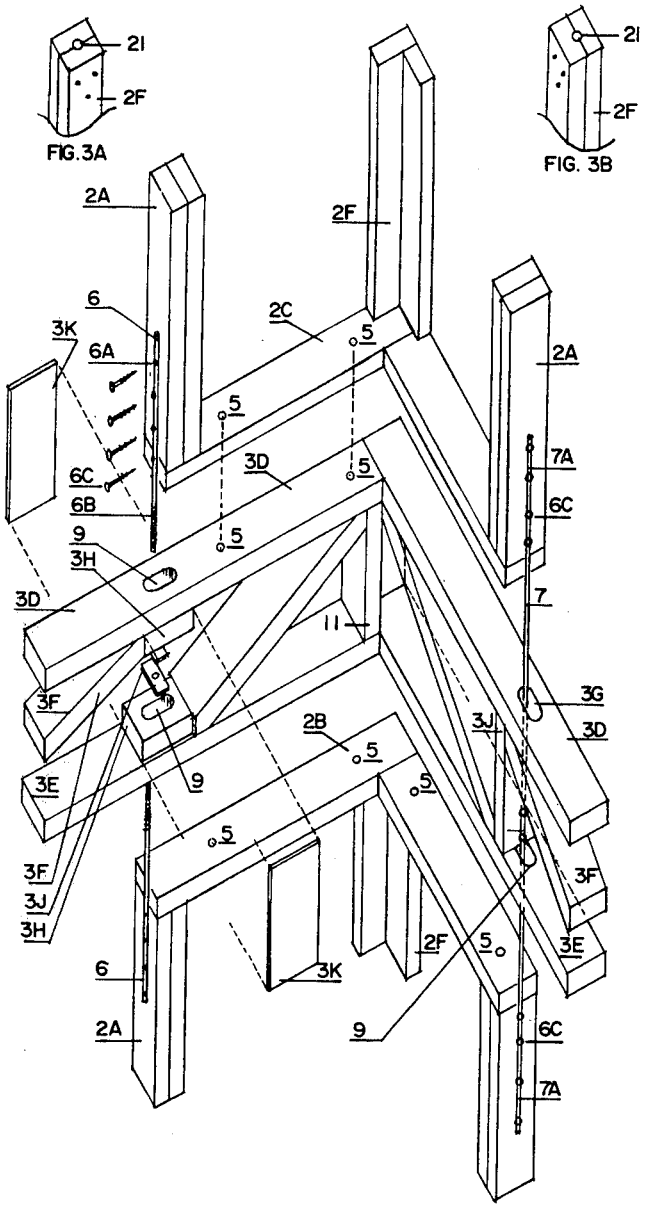
FIG. 3 is an axonometric view of one of the corner connection detail between the frame of the ceiling/floor units and the frame of corner wall units.

FIG. 3 shows a corner detail of both the perimetrical frame of the ceiling/floor component and the corner wall component 2. The bottom plates 2C, frame members shown as a double stud 2A, corner studs 2F and top plates 2B are the key members of the corner wall skeleton or components.

Also shown in FIG. 3, is a corner portion of the ceiling/floor component 3. It includes the perimetrical frame top chords 3D, spaced and parallel bottom chords 3E, webs 3F, open holes or apertures 9, for connectors and electrical wiring and the like, and vertical wooden webs 3J. The optimum location of nails or other suitable fasteners, which are used to secure the position of the corner wall components against stresses temporarily, are shown by reference character in FIG. 3.

Connectors between the frames of the corner wall components 2 and the perimetrical frames of the ceiling/floor components, may take several forms. FIG. 3 shows two examples. In one example, steel rods 6 are secured as by screws 6C, through apertures 6A in the rods, to the outer studs 2A of the corner members and extend downwardly insofar as the upper corner members are concerned and upwardly insofar as the lower corner members are concerned.

It will be appreciated that the lower corner members are secured to the underside of the transition ceiling/floor component and the upper corner members are secured to the upper side thereof. If only one storey is being constructed then, of course, the component 3 becomes the floor component at the lower side of the cube with the upper corner components being secured by rods 6 and a similar component 3 is then engaged on the upper ends of the corner components to be secured by rods 6 extending upwardly from the upper ends of the corner components. In either case, the distal ends 6B of the rods are screw threaded and, when the corner components are engaged with the corners of the perimetrical frames of the ceiling/floor components as shown in FIG. 3, these rods extend through the apertures 9 and through an apertured reinforcing block 3H secured on the inner face of the chords 3E and 3D. Apertured steel reinforcing plates 3J then engage upon the screw threaded ends 6B and nuts (not illustrated) screw threadably engage the ends of the rods thus bolting the corner components firmly in position to the ceiling/floor component 3.

These screw threaded rods, as hereinbefore described, are suitable for the connection of the corner components 2 to the floor and ceiling components of a single cube skeleton structure. However, if a two-storey structure is being provided as shown in FIG. 2, then a single steel rod 7 may be used. Such rods should be secured as by screws 6C or other suitable means, through apertures (not illustrated), through the rod intermediate the ends thereof and into a vertical member 3J extending between the upper and lower chords 3D and 3E. These rods then extend upwardly and downwardly through the apertures 9 and, when the corner components 2 are correctly positioned, the ends 7A of this rod 7 are secured to the outer studs 2A by screws 6C through apertures 6A as described for the aforementioned individual rods 6.

It is possible to insert between the chords 3D and plates 2C, any sub-floor or any other layer of a relatively hard nature which could then contribute to the rigidity of the structure when erection is completed.

It will also be noted that gussets 3K for bracing may be secured to the chords 3D and 3E at the area of the rod connections in lieu of one of the vertical webs at this point. These gussets or bracing plates may be wood, steel, aluminum or any other appropriate material. They can be secured to the chords 3D and 3A through apertures within the gussets, by means of nails, screws or similar connecting means.

In steel structures, components such as 3G, 3J, 3H and 3F are not necessary because conventional metal joists which could be welded in the form of a perimetrical frame, can be used. A similar situation exists in plastic material modifications. The important thing is to ensure the exact assembly of the skeleton members, to prevent those stresses which occur during construction by nailing at 5, and to secure the rigidity of the skeleton structure by the securing components or connectors 6 and 7 and to ensure the correct installation of the fill-in wall between the top and bottom chords. Only this system allows for easy disassembly of the structure when necessary.

Figure 4:
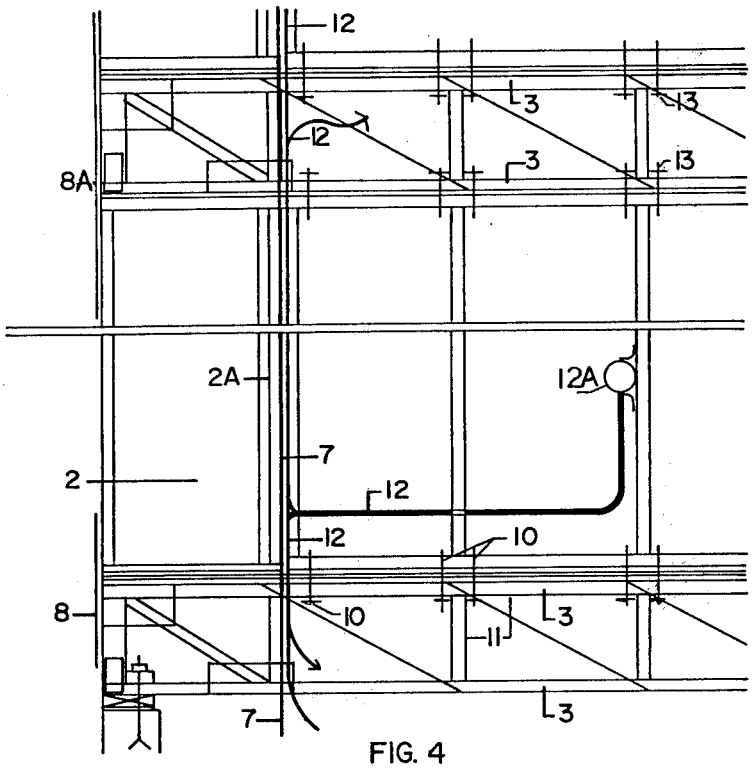
FIG. 4 is a side elevational view showing two-dimensional representation of a ceiling/floor frame member, a corner wall frame and a fill-in wall frame, including wiring.

FIG. 4 shows schematically an elevation of the ceiling/floor component 3, typical connectors 11 between chords of the frame, rods or connectors 7, wiring 12 between electrical outlet 12A located in the fill-in wall component and screws 10 for securing the fill-in wall component to the upper and lower chord of the ceiling/floor frame. Other forms of securement can be used. The corner plate connectors 8 are shown nailed to the outer sides of the ceiling/floor components and the corner wall components are shown by 8A. Rods 7 are screwed to corner wall frame 2A as shown at 13.

Figure 5:
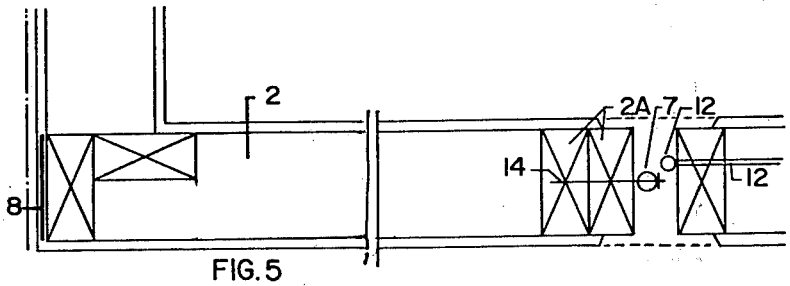
FIG. 5 is a fragmentary schematic plan view showing the opening in top and bottom chords of upper and lower plates of the ceiling/floor component frame for both rods as connectors and electrical wiring between ceiling/floor space and along the stud inside the fill-in wall.

FIG. 5 shows schematically, a horizontal cross section through corner wall 2 and fill-in wall 4, including wiring 12 and connectors 7 secured by screws or nails 13 into corner wall frame 2A.

Figure 6:
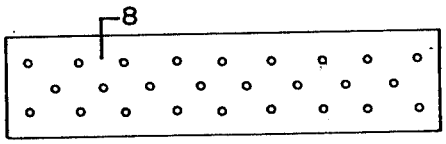
FIG. 6 is a plan view of a corner nail connector.

FIG. 6 shows steel (or other material) plate 8 of appropriate size.

Figure 7:
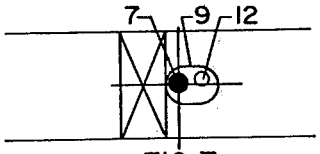
FIG. 7 shows schematically, the typical shape of the hole in upper and bottom chord of the ceiling/floor frame for the purpose of providing both connectors between the corner wall and ceiling/floor frame and electrical wiring between ceiling/floor member and fill-in wall.

FIG. 7 shows schematically, a horizontal cross section through the connector detail in ceiling/floor component. Opening is shown at 9, rod connector at 7 and electrical wiring at 2B.

Figure 8:
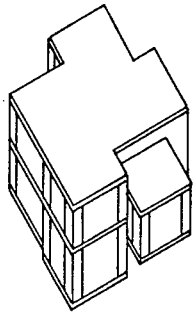
FIG. 8 is a schematic example of the assembly of cube structures into a two-storey setting.

FIG. 8 shows an example of two-storey structure assembly.

Figure 9:
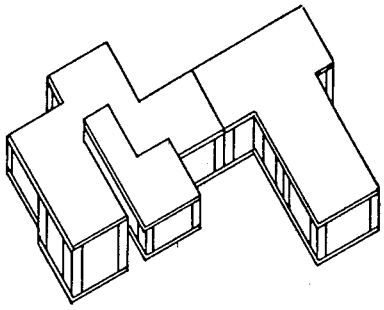
FIG. 9 indicates schematically how the cube structure as shown in FIG. 8 may be dissembled and reassembled in a setting of one-storey structure.

FIG. 9 shows conversion of the two-storey structure as shown in FIG. 8 into bungalow type of structure.

Figure 10:
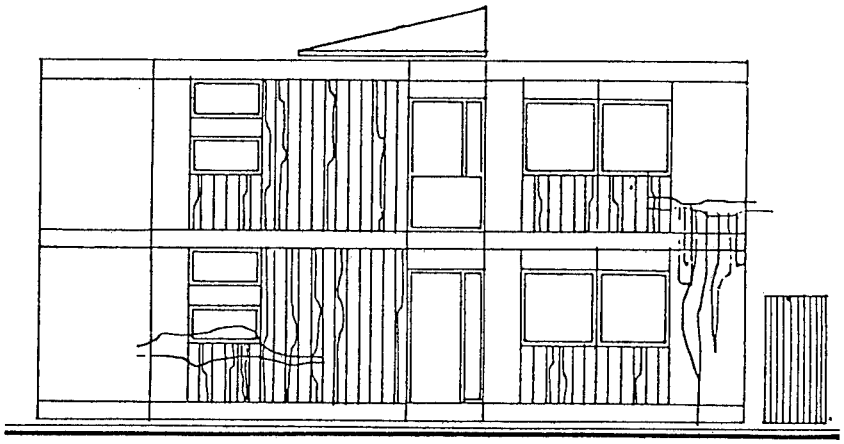
FIG. 10 is a schematic view of an example of a residential cube structure exterior elevation.

FIG. 10 shows an elevation scheme created by the structural substance of the cube skeletons.

FIGS. 11 and 12 shows schematically, the ceiling/floor component 3 used as the transition between the lower and upper storeys and having overall dimensions larger than the dimensions of the lower cube unit. These additional dimensions can either be on one side, two sides or even more sides and are indicated in FIGS. 11 and 12 by reference character 15. These extend beyond the confines of the lower cube unit in a cantilever fashion and the corresponding upper cube unit may also extend as indicated by reference character 16 to provide additional space either in the form of additional room space, or alternatively, as shown in FIG. 12, as a balcony designated 17. In this connection, balcony railings 18 may extend upwardly from the outer side of the ceiling/floor component 15 braced by vertical braces 19 secured by screws or the like 20. The connections between the upper and lower corner units and the transitional ceiling/floor components 3 are by connectors 6 or 7 as hereinbefore described.

Also to be noted, are FIGS. 3A and 3B in which the corner members 2F are formed by a pair of $2\times4$ or $2\times6$ units connected together by nails or the like and having a vertical drilling 21 extending through at least the end portions and formed by semi-circular grooves in the opposing faces which, when joined, define a substantially cylindrical vertical aperture. Connector rods such as 6 or 7 having barbed or serrated aperture engaging portions, extend into these vertical drillings and are held frictionally therein with the other ends extending through corresponding drillings within the chords 3D and 3A to provide additional support through the connections between the corner components 2 and the ceiling/floor component 3.

In assembly, a ceiling/floor unit 3 is first placed on the previously prepared supporting surface such as basement walls, piers, slabs or the like. This ceiling/floor component is similar to that shown in FIG. 2 with part of the sub-floor 3B in place and secured to the joists leaving the perimetrical space clear around the sub-floor for access to the perimetrical frame of the component 3.

The corner wall components 2 are then erected at the corners of the perimetrical frame and positioned and nailed into position by nails extending through the pre-drilled apertures 5, or alternatively, the nails may be driven through the plates 2C and into the chords 3D. Members 6, previously secured to the outer studs 2A of the corner components engage through the apertures 9, through the reinforcing blocks 3H and through the plates 3J whereupon a nut is engaged over the screw threaded ends 6B of these connectors 6 thus securely fastening the corner components in the proper relationship to the ceiling/floor component 3. Nailing plates 6 may then be engaged to further support the corner components.

In this connection, it will be observed that access to the lower ends of the connectors 6 is from the inside of the structure through the spacing 3C around the sub-floor 3B, it being understood that the outer surfaces of the ceiling/floor component may be pre-finished.

The upper ceiling/floor component 3 is then engaged upon the upper ends of the corner components 2 and secured by connectors 6 extending upwardly from the outer studs as shown in FIG. 3, once again nuts being used to engage the screw threaded ends 6B of the connectors thus holding the upper ceiling/floor component firmly in the correct position upon the upper ends of the corner wall components 2.

Pre-finished wall components 4 are then engaged between the adjacent outer studs 2A of corner components and are screwed to the upper and lower components 3, once again access being provided through the perimetrical space around the sub-floor 3B.

If a second storey is required then further corner components 2 are mounted upon the upper side of the upper component 3 and secured in a manner similar to that hereinbefore described or alternatively, utilizing the one-piece connectors 7 shown in FIG. 3 and hereinbefore described. A final ceiling/floor component 3 is then positioned and secured upon the upper ends of the upper corner components 2 and any roof finish (not illustrated) may then be applied after the fill-in wall components 4 have been inserted.

The floor is then completed by engaging strips upon the open areas around the sub-floor 3B and the ceiling material is installed. Vertical seams between the fill-in wall components 4 and the corner wall components 2 may be filled by relatively thin strips and taped so that the finish both externally and internally is flush. The necessary fill-in panel components 4 will be provided with conventional doors and/or window units (not illustrated) for access purposes.

Disassembly is a reversal of the above procedure so that the individual cube structures can be disassembled and transported to another location for re-use or alternatively, added on in a different location to the basic structure in a manner similar to that shown schematically in FIGS. 8 and 9.

It will be appreciated that the necessary electrical connections can be made at the connecting points between the fill-in wall components 4 and the corner components 2 through the apertures 9 as illustrated and described in FIGS. 4, 5 and 7.

It should be stressed that, under normal design circumstances, the skeletal structure consisting of the floor and ceiling components 3 and the corner components 2 take all of the bearing load whether it is one or two storeys with the fill-in walls being non-load bearing and easily attached and detached after the basic structure has been erected. Furthermore, the location of the corner components relative to the ceiling and floor components 3 is simple with the vertically extending connectors clamping the entire assembly together as a one-piece structural unit.

Since various modifications can be made in my invention as hereinabove described, and many apparently widely different embodiments of same made within the spirit and scope of the claims without departing from such spirit and scope, it is intended that all matter contained in the accompanying specifications shall be interpreted as illustrative only and not in a limiting sense.

I claim:

1. A plurality of statically complete and independent cube skeleton structural unit components for detachable arrangement and securement together with adjacent surfaces being in interfacial flush relationship, each of said components comprising in combination a pair of similar square horizontal ceiling/floor components each including a perimetrical frame and load bearing means for maintaining the components in spaced and parallel relationship with one another, said load bearing means consisting solely of four L-shaped cross sectioned corner bearing wall components each of which directly abuts and is secured at each end thereof to a corresponding corner of the associated frame of said horizontal components at the upper and lower edges of the bearing wall components, vertically extending means for operatively and detachably connecting said ceiling/floor components and said bearing wall components together, each of said bearing wall components including a pair of vertically situated flanges at right angles to one another for reducing the span of the roof component frame members, the thickness of the perimetrical frame and the thickness of the flanges of the L-shaped bearing wall components being similar to produce a flush fitting smooth inner and outer surface therebetween so that the vertical center line of the portions of the perimetrical frame overlying the flanges and the vertical center line of each of the flanges of the L-shaped bearing wall components are in corresponding vertically alignment thus developing the said statically complete and independent cube skeleton structural unit, fill-in, non-bearing wall components detachably secured between the outer edges of said horizontal components and extending therebetween, the thickness of said non-bearing wall components being substantially equal to the thickness of the vertically situated flanges of said bearing wall components and at least one lateral edge of the non-bearing wall components being secured to a corresponding lateral edge of said vertically situated flange so that the non-bearing wall components form a flush continuation of said vertically situated flanges of said bearing wall components.

2. The invention according to claim 1 in which said means for operatively and detachably connecting said ceiling/floor components and said bearing wall components together includes securing connectors adjacent the upper and lower ends of said L-shaped bearing wall components operatively engaging adjacent perimetrical frames to detachably clamp said units together.

3. The invention according to claim 1 in which said means for detachably securing said L-shaped wall components to said ceiling/floor components includes a vertical connector rod secured by one end thereof to the lateral edge of said vertically situated flanges and extending therefrom, a screw threaded distal end on said connector rod, an access aperture formed in said perimetrical frame through which the screw threaded distal ends of said connector rods with said perimetrical frame of said ceiling/floor components to clamp said L-shaped wall components into position relative to said ceiling/floor components.

4. The invention according to claim 1 in which the width of the vertically situated flanges of said L-shaped bearing wall components is approximately 1/7th of the length of one side of the ceiling/floor components and the width of the non-bearing fill-in walls is approximately 5/7th of the length of one side of the ceiling/-floor components.

5. The invention according to claim 2 in which the width of the vertically situated flanges of said L-shaped bearing wall components is approximately 1/7th of the length of one side of the ceiling/floor components and the width of the non-bearing fill-in walls is approximately 5/7th of the length of the side of the ceiling/-floor components.

6. The invention according to claim 3 in which the width of the vertically situated flanges of said L-shaped bearing wall components is approximately 1/7th of the length of the side of the ceiling/floor components and the width of the non-bearing fill-in walls is approximately 5/7th of the length of one side of the ceiling/-floor components.

7. The invention according to claim 1 in which said perimetrical frame includes openings which lie adjacent to the inside faces of the L-shaped bearing wall components, said openings being formed through said perimetrical frame adjacent to each of said L-shaped bearing wall components thus developing structural provisions for servicing the structure and providing access to said means for securing said unit together, and detachable plates selectively closing off access to said openings.

8. The invention according to claims 2 or 5 in which said perimetrical frame includes openings which lie adjacent to the inside faces of the L-shaped bearing wall components, said openings being formed through said perimetrical frame adjacent to each of said L-shaped bearing wall components thus developing structural provisions for servicing the structure and providing access to said means for securing said unit together, and detachable plates selectively closing off access to said openings.

9. A plurality of statically complete and independent cube skeleton structure units as defined in claim 1, detachably arranged together to form a complete multi-roomed structure with no static relation of one cube structure to the other in horizontal arrangement but in static stacked frame inter-relationship of two cube structure units when stacked one above the other, both sharing one common ceiling/floor component and including a lowermost ceiling/floor component, an L-shaped bearing wall component extending upwardly from the corners of said lowermost ceiling/floor component and being secured thereto, a common ceiling/-floor component secured to the upper ends of said L-shaped bearing wall components, a further L-shaped bearing wall component adjacent each corner of said common ceiling/floor component and extending upwardly therefrom and being secured thereto and an uppermost ceiling/floor component secured to the upper ends of said further L-shaped bearing wall components.

10. The invention according to claim 9 in which said means to detachably secure said L-shaped bearing wall components and said further L-shaped bearing wall components to said common ceiling/floor component includes a vertically situated connector rod adjacent each vertical edge of said connector L-shaped bearing wall components and extending through said common ceiling/floor component and being secured thereto in vertical relationship, intermediate the ends thereof, upper and lower access apertures formed in the said common ceiling/floor component, the ends of said rods extending through said apertures, the lowermost distal ends of said rods being secured to said L-shaped bearing wall components, the upper distal ends of said rods being secured to said further L-shaped bearing wall components.

11. The units according to claim 10 which include at least one side of said common ceiling/floor component extending in cantilever fashion beyond the adjacent one side of the lowermost of said two cube skeleton structure units thereby defining an additional floor area to the uppermost of said two cube skeleton structure units.

12. The invention according to claim 9 in which said both single cube units and said stacked units are arranged and secured in a relationship consisting of cube structure units at the same horizontal level.

13. The units according to claim 9 which include at least one side of said common ceiling/floor component extending in cantilever fashion beyond the adjacent one side of the lowermost of said two cube skeleton structure units thereby defining an additional floor area to the uppermost of said two cube skeleton structure units.

14. The invention according to claims 12 or 13 in which said additional floor area is incorporated within the non-load bearing wall component of said uppermost cube skeleton structure unit.

15. The invention according to claims 12 or 13 in which said additional floor area is situated beyond the adjacent non-load bearing wall component thereby defining a balcony area.

16. The invention according to claim 9 in which said both single cube units and said stacked units are arranged and secured in a relationship consisting of a misaligned horizontal level.

17. The invention according to claim 9 in which said both single cube units and said stacked units are arranged and secured in a relationship consisting of two horizontal group directions.

18. The invention according to claim 9 in which said both single cube units and said stacked units are arranged and secured in a relationship consisting of an irregular cluster system.

* * * * *